US005992365A

United States Patent [19]

Vilou

[11] Patent Number: 5,992,365

[45] Date of Patent: Nov. 30, 1999

[54] METHOD AND DEVICE FOR CONTROLLING THE CUT-OFF OF A MOTOR VEHICLE STARTER

[75] Inventor: Gérard Vilou, Tassin, France

[73] Assignee: Valeo Equipements Electriques Moteur, Creteil, France

[21] Appl. No.: 08/938,778

[22] Filed: Sep. 26, 1997

[30] Foreign Application Priority Data

Sep. 27, 1996 [FR] France ..... 96 11792

[51] Int. Cl.[6] ..... F02N 11/08

[52] U.S. Cl. ..... 123/179.3; 290/38

[58] Field of Search ..... 123/179.3, 179.4, 123/179.2; 290/38 R, 38 C

[56] References Cited

U.S. PATENT DOCUMENTS 4,198,945 4/1980 Eyermann et al. ..... 123/179 B
4,947,051 8/1990 Yamamoto et al. ..... 290/38 R
5,743,227 4/1998 Jacquet et al. ..... 123/179.3

FOREIGN PATENT DOCUMENTS 2 393 165 12/1978 France .
2 626 417 7/1989 France .

*Primary Examiner*—Tony M. Argenbright
*Assistant Examiner*—Arnold Castro
*Attorney, Agent, or Firm*—Morgan & Finegan, LLP

[57] ABSTRACT

Interruption of the power supply to a motor vehicle starter, so as to cut off the starter, is controlled automatically by detecting the fluctuations in the power supply voltage of the starter, and by then interrupting the power supply when these fluctuations disappear. For each new fluctuation in the power supply voltage, a monitoring period is generated. The duration of this monitoring period is such that the latter terminates substantially after the occurrence of a peak in the fluctuation, and the power supply is interrupted when no peak has been detected in the last monitoring period.

16 Claims, 2 Drawing Sheets

METHOD AND DEVICE FOR CONTROLLING THE CUT-OFF OF A MOTOR VEHICLE STARTER

FIELD OF THE INVENTION

The present invention relates to a method and a device for the automatic cut-off of a motor vehicle starter. In this specification, including the claims of this Application, "cut-off" means stopping the operation of the starter by interrupting the power supply to the starter motor, whereupon, in the conventional way, the starter head becomes disengaged from the engine of the vehicle.

BACKGROUND OF THE INVENTION

Conventionally, the starter starts the heat engine of a vehicle by driving the engine until the engine has fired so that it is thereafter driving itself. Once the engine is driving itself, the starter should be cut off, i.e. stopped, as quickly as possible. Conventionally, the driver of the vehicle releases the ignition key so as to cut off the starter when the engine makes a characteristic sound indicating to the driver that the engine is now running.

However, the recent tendency to make engines more and more silent leads to difficulties for the driver in detecting the characteristic sound mentioned above, so that there is a tendency to run the starter for longer than necessary, with the consequent occurrence of severe and unnecessary forces exerted between the starter and the engine.

Numerous devices are already known for cutting off a motor vehicle starter when the engine has been started, i.e. when the engine is autonomous enough to attain its slow running mode by itself. The most satisfactory of these devices generally make use of an analysis of the fluctuations which occur in the power supply voltage to the starter. These fluctuations are due to variations in the electric current absorbed by the starter during the compression strokes of the engine, before the engine has been fully started.

It is known that at the end of the driving period, i.e. the period during which the engine is being driven by the starter, and during the first explosions in the engine, the running mode of the engine climbs rapidly. This is illustrated in the graph shown in FIG. 1 of the accompanying drawings, in which the development of the power voltage UBAT is shown as a function of time during a starting operation.

The duration of these fluctuations, and in particular that of the decompression phases, then diminishes rapidly. In systems proposed hitherto, monitoring takes place in successive "windows" of time, or monitoring periods (such as are indicated in FIG. 1 at D1 to D4), the duration of each of which, apart from the first, corresponds at least to the complete period of the preceding fluctuation. These monitoring periods do not take into account the progressive reduction in the duration of the decompression strokes of the engine. Thus, it is only at the end of the last monitoring period (D4 in FIG. 1), the duration of which corresponds to at least that of the preceding cycle of the engine, that it can be seen whether a new fluctuation has occurred or not in this last time window D4. Consequently it is only then that the decision can be taken to stop the operation of the starter.

It can be seen with reference to FIG. 1 that this final monitoring period is too long, in that the decision to cut off the power supply to the starter is much too late after the instant at which the engine has become autonomous, which is indicated at DR in FIG. 1.

DISCUSSION OF THE INVENTION

An object of the invention is therefore to propose a new control device which enables the power supply to the starter to be cut off more rapidly.

In addition, the voltage signals are generally subject to a high level of electrical noise due to parasitic effects in the switching system of the starter. This is why an active filter is commonly used in order to give effective filtering of this noise. However, such an active filter has the disadvantage of being expensive, and the further disadvantage that it increases the response time of the system.

A further object of the invention is therefore to propose an arrangement which overcomes this problem.

According to the invention in a first aspect, a method for controlling the cut-off of a starter of a motor vehicle, in which the fluctuations in the power supply voltage of the starter are detected, and the starter is stopped when these fluctuations disappear, is characterised in that a monitoring period is generated for each new fluctuation, the duration of each monitoring period being such that the latter terminates substantially after the occurrence of a peak of the said fluctuation, and in that the starter is stopped when no peak has been detected in the last monitoring period.

In this specification, including the claims of this Application, the word "peak" means, with respect to the waveform (curve) representing the fluctuating voltage, a point of either maximum or minimum amplitude on the curve, except where the context indicates that it means a maximum and not a minimum, or vice versa.

With the method of the invention, when the engine starts, the starter power supply is interrupted immediately after the time in which a voltage peak was expected but failed to happen.

According to a preferred feature of the invention, the signal on which a peak in the power supply voltage to the starter is detected is a chopped signal, and each monitoring period is commenced when the said signal begins to have a non-zero value. In this way, a signal from which parasitic effects are absent is given over the whole time for which the value of the signal is zero. This eliminates risks of error. In addition, the start of each monitoring period is precisely determined.

According to the invention in a second aspect, a device for controlling the cut-off of a starter for a motor vehicle, comprising means for detecting fluctuations in the power supply voltage of the starter, and means for stopping the starter when these fluctuations disappear, is characterised in that it comprises means for generating, for each new fluctuation, a monitoring period, the duration of which is such that the said period terminates substantially after the occurrence of a peak in the said fluctuation, together with means for stopping the starter when no peak has been detected in the last monitoring period.

Further features and advantages of the invention will appear more clearly on a reading of the following detailed description of some preferred embodiments of the invention, which is given by way of non-limiting examply only and with reference to the accompanying drawings.

DESCRIPTION OF PREFERRED EMBODIMENTS OF THE INVENTION

Figure 1:
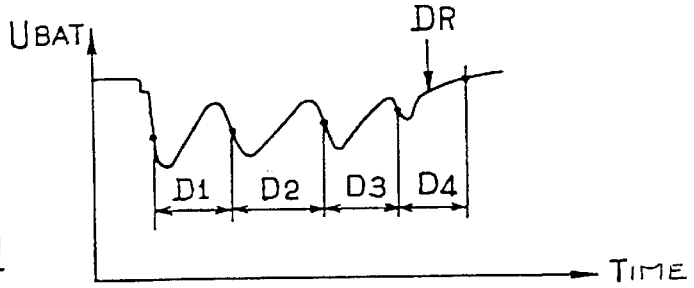
FIG. 1, to which reference has already been made above, is a graph showing the development of the starter power supply voltage as a function of time during a starting phase.
Figure 2:
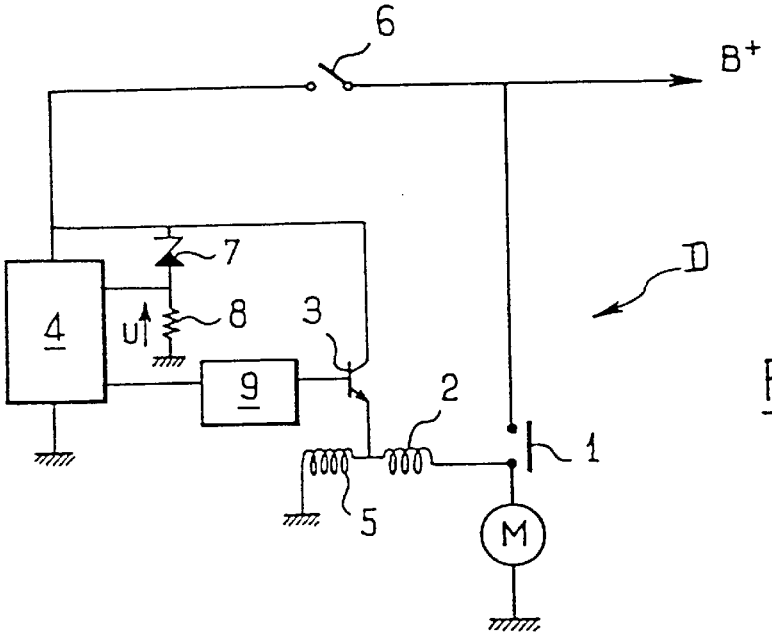
FIG. 2 is a simplified general circuit diagram for a cut-off control device for a starter in one possible embodiment of the invention.

FIG. 2 shows a device for controlling the power supply of a starter D for a motor vehicle internal combustion engine. The motor M of the starter is connected between a power supply terminal at the battery voltage $B^+$ of the vehicle, and ground (earth). The device includes a contactor 1 which is connected between the terminal $B^+$ and the starter motor M.

The contactor 1 is in the form of a relay actuated by a relay coil 2. One end of the relay coil 2 is connected to the common terminal of the starter motor M and the contactor 1. Its other end is connected firstly to the source of a MOSFET transistor 3, and secondly to a coil 5 which is connected to ground at its other end. It will of course be understood that the transistor 3 may be replaced by any other suitable type of interrupter. The drain of the transistor 3 is connected to the power supply terminal $B^+$ through the ignition switch 6, operated by the ignition key; and its grid is connected to the output of a control module 9 which is itself actuated by a signal processing unit 4. The signal processing unit 4 is for example in the form of a microprocessor.

The power supply terminal $B^+$ is connected to a first input of the signal processing unit 4 through the ignition switch 6. It is also connected, again through the ignition switch 6, to a second input of the signal processing unit 4, through a Zener diode 7 which is connected so as to be in the passing state from the associated input of the unit 4 towards the ignition switch 6. A resistor 8 is also connected between the second input (which is connected to the anode of the Zener diode 7) and ground. The voltage measured at this second input of the unit 4 is the voltage U across the resistor 8.

When the signal processing unit 4 detects, from the voltage at its first input, that the ignition switch 6 has been closed, it sends, through the control module 9, a signal for closing of the contactor 1. The unit 4 then analyses the voltage U so as to determine the instant at which actual starting of the engine of the vehicle occurs, whereupon it immediately commands that the power supply to the starter motor M be cut off.

Figure 3:
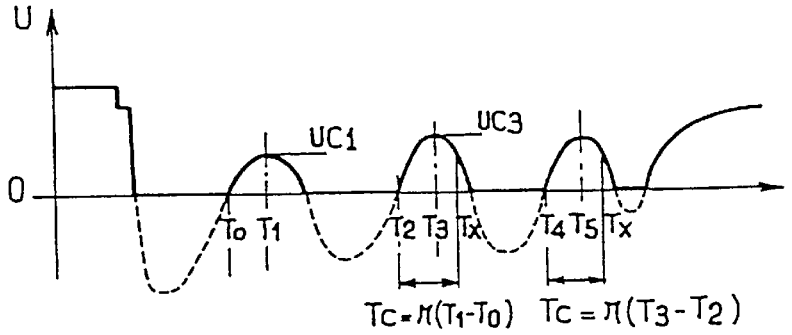
FIG. 3 is a graph showing the development with time of the voltage U which is analysed by a signal processing unit of the starter, and which shows one possible embodiment of the invention.

FIG. 3 shows the fluctuating voltage U in full lines. The fluctuations are chopped, by removal of their lower values, by the Zener diode 7. For this purpose, the Zener voltage of the diode 7 is selected so as to be lower than the peak values of the power supply voltage to the starter. These values correspond to the discharged voltage of the battery, reduced by the voltage drops in the battery and in the associated cables under the effect of the current absorbed by the starter. For heat engines with an engine capacity between 1 and 2 liters, and with starters of 1 kW power rating, the peak voltage generally lies in the range between 10 and 11 volts. The diode 7 is therefore, for example, selected to have a Zener voltage of the order of 9 to 10 volts.

In this way, the fluctuating voltage signal U across the resistor 8 is deprived of its unidirectional component and the troughs of its alternating component. Accordingly, over the whole duration of a trough in the power supply voltage (represented in broken lines in FIG. 3), the signal no longer includes any parasitic effects, and this eliminates risks of any error.

Detection of the instant DR, at which the engine becomes self-driving, is effected in the following way. When the contactor 1 closes, the signal processing unit 4 looks for the occurrence of a zero voltage across the resistor 8, and then determines the time T0 at which a positive voltage appears.

The unit 4 then determines the time T1 at which the first peak voltage UC1 occurs. This time T1 can be determined in various ways, for example by verifying the moment at which the derivative of the voltage U becomes zero. This may be achieved by using an analog differentiator circuit or by calculating the differential of the voltage U. More simply, it may also compare the maximum value UCi in a batch of one or more measurements of voltage with respect to the maximum value UC(i−1) of a preceding batch; when UCi<UC (i−1), the peak has just been passed.

Once the time T1 has been determined, the unit 4 waits for the signal to become zero again and then to become positive again at a time T2. It then determines whether a new voltage peak UC3 occurs between the time T2 and a time Tx, which is defined by T2+TC, where TC=M(T1−T0), M being a parameter which has been set beforehand with a value between 1 and 2. If no peak has been detected, this signifies that the engine of the vehicle has been started. The unit 4 therefore gives a signal to order that the power supply to the starter should be cut off by the control module 9.

However, if a voltage peak does in fact occur effectively in this time interval, this signifies that fluctuations are still occurring, and that the engine has not yet started. The unit 4 memorises the time T3 corresponding to this peak UC3, and then repeats the process, replacing T0 with T2 and replacing T1 with T3 and TC with M(T3−T2). In this way, the unit 4 determines, in the next fluctuation, whether a new peak occurs between the time T4 and the new time Tx which is T4+M(T3−T2).

The procedure is continued in the same way until the end of the first window of observation (monitoring period) during which no fresh voltage peak is detected.

It will be noted that in this embodiment, the order for cut-off of the starter motor takes place after the last trough (in broken lines in FIG. 3), after which the system is beyond the instant Tx prior to which the new voltage peak was awaited.

In this way a particularly rapid response time is obtained, which is, in particular, shorter than the response time obtained by an arrangement in which the order for cut-off of the starter takes place after the last trough at the end of a time window having a duration which is greater than the duration of the preceding compression stroke of the engine.

Figure 4:
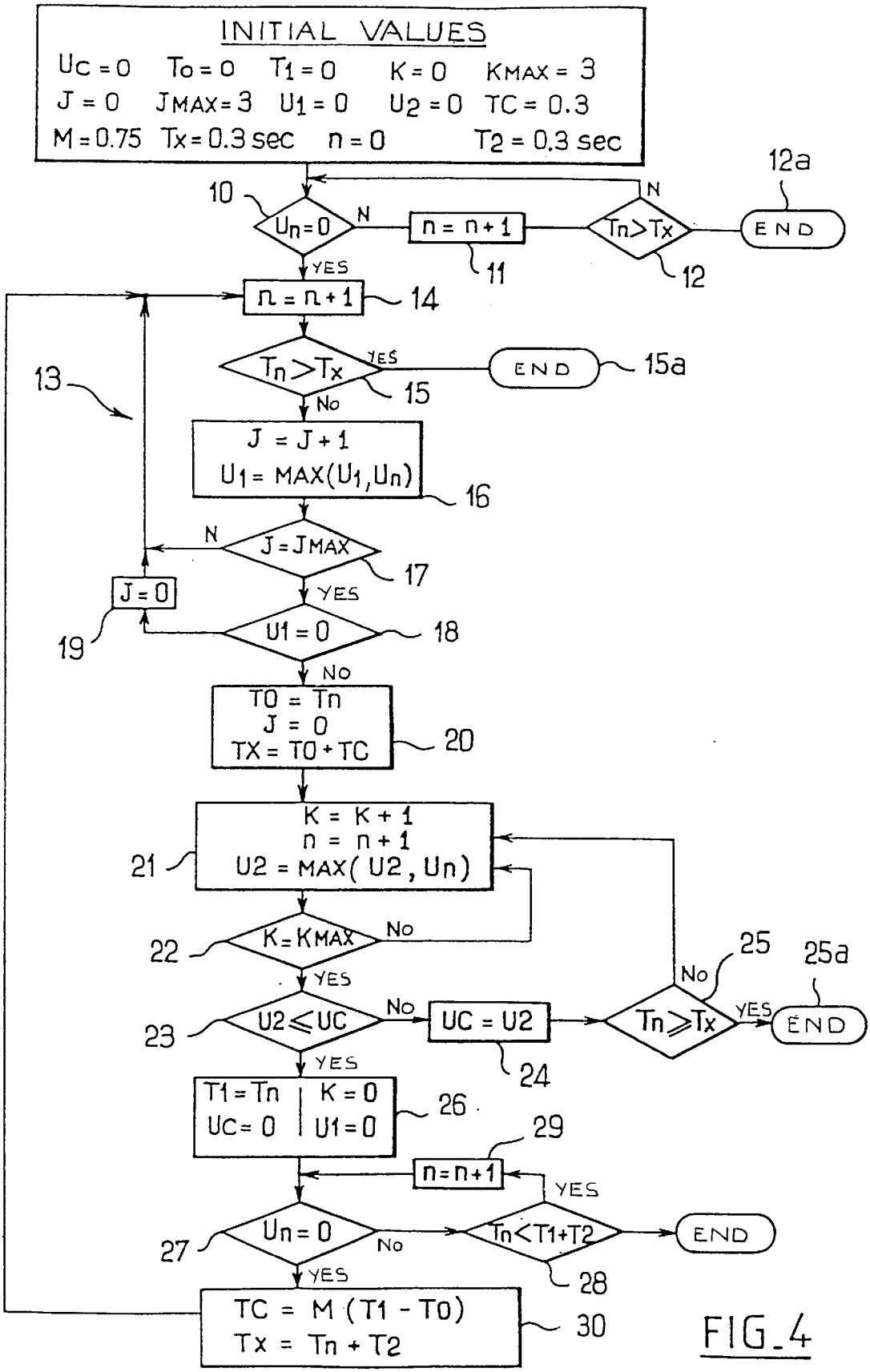
FIG. 4 is a process chart showing one possible version of the method in accordance with the invention.

Reference is now made to the progress chart of FIG. 4, which shows one possible example of a sequence in the starter cut-off strategy just described.

Measurements Un are carried out periodically on the voltage U at instants of time Tn in a succession defined such that the interval of time between an instant Tn and the next instant in the succession, T(n+1), corresponds to a monitoring period of the microprocessor.

A test 10 is first carried out to find out whether the value Un is zero. If this is not the case, the value of n is increased by one in a step 11, and a test 12 is carried out to find out whether the new time Tn is not greater than a time Tx chosen beforehand, the time Tx being for example equal to 0.3 seconds.

If Tn is greater than this time Tx, this signifies that U has not taken a zero value during the time interval between 0 and Tx, and it is considered that an incident has occurred. The unit 4 therefore cuts off the power supply to the starter motor, and the process is terminated at 12*a*. Such an incident may for example be due to failure of the contactor 1 to close. Another possible cause may be interruption of the power circuit comprising the relay coil 2 and the inductive coil 5. A further cause may be free operation of the starter, in which the starter pinion has failed to mesh with the starter crown on the flywheel, or in which a mechanical power component has failed, and so on.

However, if the time Tn is effectively shorter than Tx, the test 10 is repeated.

When one of the values Un of the voltage U is zero, a verification is carried out, in a feedback step 13, that U is effectively zero over several successive sampled values, that is to say the zero value detected for U is not a false detection which could be due to a parasitic effect. To this end, n is replaced by n+1 in a step 14.

A step 15 is then carried out, to verify whether the new time Tn is not still greater than Tx. If Tn is greater than Tx, the signal processing unit 4 does of course cut off the power supply to the motor, and the process then terminates at 15*a*. This signifies in practice that the positive fluctuation did not occur when it was due. This incident may have a number of causes, such as a short circuit in the starter, the starter being jammed, the engine being jammed, the battery charge being too low, and so on.

If however Tn is less than Tx, a step 16 is carried out in which J is replaced by J+1 and U1 is replaced by the largest value between U1 and Un, J being an index of incrementation the initial value of which is zero, and U1 being a parameter the initial value of which is zero. This is followed by a step 17, in which a test is carried out to find out whether the new value of J is or is not equal to JMAX, which is a selected value, equal for example to 3. If J is not equal to JMAX, the process is repeated, starting with step 14 in which n is again replaced with n+1.

If however J is found to be equal to JMAX, a step 18 is performed to verify the value of U1. If U1 is zero, then J is zeroed in a step 19, and the process is repeated once again starting with step 14, which again puts an increment on n.

If, however, U1 is not zero in step 18, this normally signifies that the voltage U is becoming positive again after a period in which it has taken the zero value. In that case, a step 20 is carried out. In step 20, T0 is replaced by Tn, and J is replaced by 0. T0 is then the starting point for the positive part of the fluctuation. Tx is then replaced by T0+TC, where TC characterises the duration of the time window which is commenced at T0. During this time window, verification is carried out as to whether or not the voltage U takes a peak value. For example, TC may for example be given the initial value of 0.3 seconds. In the next step, 21, n is then replaced by n+1, and K by K+1, where K is an index of incrementation, the initial value is zero. In addition, in this step, U2 is replaced by the larger of the two values U2 and Un, where U2 is a parameter having a zero initial value.

This is followed by a test 22 to find out whether K has or has not reached its maximum value KMAX (which may for example be selected to be equal to 3). If K has not reached KMAX, the step 21 is repeated, by incrementing K and n, and by modifying the value of U2 as necessary. This feedback, using the incrementation index K, enables assurance to be obtained that the measurement of U2 has not been falsified by some parasitic effect.

When K does achieve its value KMAX, a test 23 is carried out to find out whether U2 is or is not less than or equal to UC, where UC is a value of voltage that characterises the maximum value attained by the voltage U during its oscillations. UC is given the initial value of zero.

If U2 is greater than UC, which signifies that the voltage U is increasing, a step 24 is then carried out. In this step, UC is replaced by U2, and this is followed by a test 25 to establish whether Tn is effectively greater than the time Tx as defined in step 20. If not, the process feeds back to step 21. However, if Tn is effectively greater than the time Tx, this signifies that no peak has been detected in the time interval TC, and the signal processing unit 4 cuts off the power supply to the starter motor, terminating the process at 25*a*.

If, in step 23, U2 becomes less than Uc within the time interval TC, this signifies that a peak has just been passed. In that case, a step 26 is performed in which T1 is replaced by Tn, and K, UC and U1 are returned to their initial zero values.

This is followed by a test 27 which checks whether Un is zero. If it is not zero, a further test 28 is carried out to see if Tn is less than T1+T2, where T2 is a fixed time parameter, equal for example to 0.3 seconds, corresponding to a maximum period of time during which the voltage U is positive. If the test in step 28 shows that Tn is greater than T1+T2, there is considered to have been an incident. Such an incident may be due to failure of the engine to fire on a compression stroke, or to an inadequate starter torque. This may for example be due to total or partial jamming, or an excessive increase in internal resistance due to heating effects, excessive discharge of the battery, and so on.

However, if Tn is effectively lower than T1+T2, the value of n is given an increment in a step 29, and step 27 is then repeated until Un is zero. This is then followed by a step 30 in which Tc is replaced by M(T1−T0) and Tx is replaced by Tn+T2, after which the whole process is repeated starting at step 14.

It will be noted that, due to the chopping effect of the Zener diode, the value of the times which correspond to the start of positive parts of the voltage signal fluctuation (such as T0, T2 and T4 in FIG. 3) is particularly precise and insensitive to noise.

Other embodiments of the invention can of course be envisaged. In particular, the duration of the time interval during which a peak can occur can be determined in ways other than by starting with the duration of the last decompression stroke (which corresponds to the rising phase of the positive portions of the voltage curve, that is to say to T1−T0, T3−T2 and so on in FIG. 3).

Figure 5:
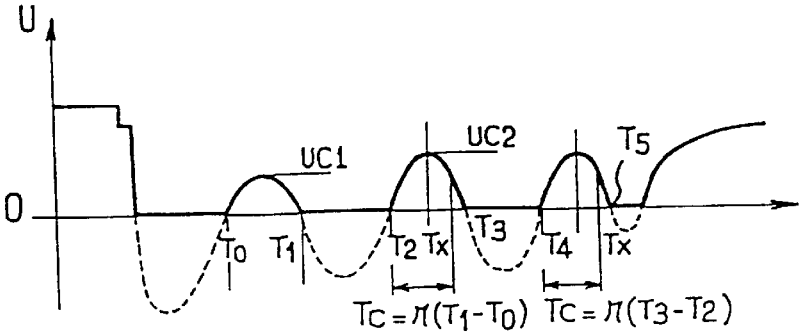
FIG. 5 is a graph similar to that in FIG. 3, showing one possible further version within the scope of the invention.

For example, as shown in FIG. 5, to which reference is now made, the time TC may be determined from the total duration of the preceding positive part of the fluctuation, by applying to this duration a coefficient M having a value between 0.5 and 1. This avoids uncertainty as to the determination of the time T1 at which the peak appears, which is relatively imprecise due to the somewhat flattened form of the wave.

Thus in FIG. 5, the new determined time T1 is that which corresponds to the reappearance of the zero voltage. Since the period of the wave is T1−T0, the peak of the next cycle of the voltage curve lies at about 0.5×(T1−T0).

Again, in all of the foregoing the preferred case has been described, in which a detected extreme value of a parameter consists of a maximum point in the curve of the supply voltage. This extreme value could, in another version, be a minimum point of the same voltage, the voltage signal being then chopped by removal of its top values.

Detection of peaks as represented by positive, or maximum, points in the supply voltage is however preferred, since the supply voltage is more regular around the maximum points than around the minimum points in the troughs.

What is claimed is:

1. A method of controlling cut-off of a motor vehicle starter comprising:

producing a signal representing a power supply voltage of the starter;

detecting a plurality of fluctuations in said signal;

generating, for each said fluctuation, a monitoring period based upon a period of time which elapsed before the occurrence of a peak in said signal during a prior fluctuation; and stopping the starter in the absence of a peak during the monitoring period.

2. A method according to claim 1, wherein the step of producing said signal further comprises chopping said signal, and wherein each monitoring period commences when said signal starts to take a non-zero value.

3. A method according to claim 2, further comprising measuring, during each said monitoring period, an elapsed time between an instant at which said signal starts to take a non-zero value and an instant at which said peak occurs, and multiplying the elapsed time by a coefficient between 1 and 2, to calculate the duration of a subsequent monitoring period.

4. A method according to claim 1, further comprising measuring, during each said monitoring period, a length of time for which said signal has non-zero values, and multiplying said length of time by a coefficient between 0.5 and 1 to determine the duration of a subsequent monitoring period.

5. A method according to claim 1, wherein each said peak corresponds to a maximum power supply voltage for each said fluctuation.

6. A method according to claim 5, further comprising chopping said signal, and wherein each said monitoring period commences when said signal starts to take a non-zero value, and wherein said signal is chopped to remove low values of the power supply voltage.

7. A device for controlling cut-off of a motor vehicle starter having a power supply, the device comprising:

a voltage sensor connected to said power supply configured to receive a signal representing the power supply voltage of the starter, and to detect a plurality of fluctuations in said signal;

a signal processor in communication with the sensor adapted to generate a monitoring period for each said fluctuation and to monitor said signal during each said monitoring period, the duration of each said monitoring period being based upon a period of time which elapsed before the occurrence of a peak in a prior fluctuation; and an actuator associated with the signal processor configured to interrupt said power supply, when there is an absence of a peak during said monitoring period.

8. A device according to claim 7, wherein the signal processor further comprises a rectifying system for chopping said signal, and the signal processor is adapted to commence each monitoring period when said signal starts to take a non-zero value.

9. A device according to claim 8, wherein the rectifying system comprises a Zener diode.

10. A device according to claim 9, wherein the rectifying system further comprises:

a resistor connected between the anode of the Zener diode and ground, and wherein the cathode of the Zener diode is electrically connected with the power supply; and a second volate sensor adapted to measure the voltage across the said resistor, whereby to detect said peaks in the voltage across the said resistor.

11. The method of claim 1, wherein the monitoring period is generated based on the time which elapsed before the occurrence of a peak in said signal during an immediately preceding fluctuation.

12. A device comprising:

a voltage sensor configured to measure a power supply voltage supplied to a motor vehicle starter so as to detect a plurality of fluctuations in said voltage;

a controller associated with the sensor and adapted to generate a monitoring period for each said fluctuation and to monitor said voltage during said monitoring period, the duration of each said monitoring period being based upon a period of time which elapsed before the occurrence of a peak in a prior fluctuation; and a switch associated with the controller, adapted to interrupt supply of said voltage to the starter when a peak is not detected during said monitoring period.

13. A method for cutting off power to a starter based upon a signal representing a power supply voltage supplied to a starter, the method comprising:

(a) monitoring the signal for a pre-determined period of time to determine when a peak has occurred;

(b) generating a monitoring period based upon the period of time which elapsed before the occurrence of a peak in the signal;

(c) monitoring the signal for a period of time equal to the monitoring period;

(d) determining whether a peak has occurred during the monitoring period;

(e) repeating steps (b) through (d) until a peak is not detected during the monitoring period; and (f) interrupting the supply of voltage to the starter.

14. A device comprising means for generating a signal representing a power supply voltage supplied to a starter;

means for generating a monitoring period based upon the period of time which elapsed before the occurrence of a peak in the signal;

means for determining whether a peak has occurred during the monitoring period; and means for interrupting the supply of voltage to the starter when no peak has occurred.

15. The device of claim 14, wherein the means for generating a monitoring period, and means for determining whether a peak has occurred comprise a microprocessor.

16. A motor vehicle comprising:

an internal combustion engine;

a starter associated with the engine and adapted to start the engine;

a battery adapted to selectively supply voltage to the starter;

a device for controlling cut-off of the starter having (1) a voltage sensor configured to measure the voltage supplied to the starter, and to detect a plurality of fluctuations in the voltage, (2) a signal processor in communication with the sensor adapted to generate a monitoring period for each said fluctuation and to monitor the voltage during each said monitoring period, the duration of each said monitoring period being based upon a period of time which elapsed before the occurrence of a peak in a prior fluctuation, and (3) an actuator associated with the signal processor configured to interrupt said power supply, when there is an absence of a peak during said monitoring period.

* * * * *